US011801984B2

(12) United States Patent
Valencia

(10) Patent No.: US 11,801,984 B2
(45) Date of Patent: Oct. 31, 2023

(54) BLANK FOR FORMING A CONTAINER TRAY

(71) Applicant: WestRock Shared Services, LLC, Atlanta, GA (US)

(72) Inventor: John Valencia, Johns Creek, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/380,723

(22) Filed: Jul. 20, 2021

(65) Prior Publication Data

US 2022/0055810 A1 Feb. 24, 2022

Related U.S. Application Data

(60) Provisional application No. 63/053,825, filed on Jul. 20, 2020.

(51) Int. Cl.
*B65D 71/64* (2006.01)
*B65D 71/58* (2006.01)

(52) U.S. Cl.
CPC ..... *B65D 71/0051* (2013.01); *B65D 71/0022* (2013.01); *B65D 2571/0045* (2013.01); *B65D 2571/00271* (2013.01); *B65D 2571/00283* (2013.01); *B65D 2571/00296* (2013.01); *B65D 2571/00382* (2013.01); *B65D 2571/00716* (2013.01)

(58) Field of Classification Search
CPC ..... B65D 71/0051; B65D 71/0022; B65D 2571/0271; B65D 2571/00283; B65D 2571/00296; B65D 2571/00382; B65D 2571/0045; B65D 2571/00716; B65D 2571/00141; B65D 2571/00277; B65D 2571/00314; B65D 2571/00475; B65D 2571/0066; B65D 2571/00833; B65D 71/16; B65D 2571/00271
USPC ..... 206/194, 427, 434, 429, 435
See application file for complete search history.

(56) References Cited

U.S. PATENT DOCUMENTS 2,300,874 A * 11/1942 De Ferrari ..... B65D 71/0055 229/194
2,351,528 A * 6/1944 Lupton ..... B65D 71/0051 206/196
2,375,631 A * 5/1945 De Villard ..... B65D 71/0055 229/161
2,731,776 A * 1/1956 Currie ..... B65D 71/30 53/48.8
2,802,597 A * 8/1957 Davis ..... B65D 71/004 206/196

(Continued)

*Primary Examiner* — J. Gregory Pickett
*Assistant Examiner* — Jenine Pagan
(74) *Attorney, Agent, or Firm* — Neil G. Cohen; Brian J. Goldberg

(57) ABSTRACT

A blank for forming a tray, wherein the blank includes a first panel extending along a lateral axis configured to form an outer side of an erected tray and a second panel extending along the lateral axis coupled to the first panel by a fold line, the second panel being configured to form an inner side of the erected tray. Each of the first and second panels includes a base section, a first lateral section foldably coupled to the base section, a first end section foldably coupled to the first lateral section, a second lateral section foldably coupled to the base section, and a second end section foldably coupled to the second lateral section.

20 Claims, 14 Drawing Sheets

(56) References Cited

U.S. PATENT DOCUMENTS

| | | | | | |
|---|---|---|---|---|---|
| 3,028,044 | A * | 4/1962 | Cochran | B65D 71/0014 | 206/183 |
| 3,106,289 | A * | 10/1963 | Chatten | B65D 73/0028 | 206/162 |
| 3,495,734 | A * | 2/1970 | Hanna | B65D 71/0037 | 206/203 |
| 4,448,308 | A * | 5/1984 | Carver | B65D 71/125 | 206/427 |
| 6,298,992 | B1 * | 10/2001 | Tsao | B65D 71/48 | 229/117.14 |

* cited by examiner

BLANK FOR FORMING A CONTAINER TRAY

BACKGROUND

Technological Field

The present disclosure relates to a blank for forming an article-carrying tray, and more particularly to a blank for forming a tray for securing and covering a plurality of articles within the tray.

Description of Related Art

Foldable trays are commonly used in the food and beverage industry to transport prepared foods and beverages. Such cartons are typically distributed as planer cutouts, or blanks, that can be folded together at the site of the food preparation. Among the advantages of designing the carton to be assembled from a foldable blank is that the blanks are simple to manufacture and can be easily distributed and stored in a stacked or palletized relationship.

Desirably, the folding sequence necessary to assemble the carton from the blank should be quick and simple to perform. Additionally, the blank should be provided as a unitary piece that does not require additional parts to produce the assembled carton on site. The carton should be assembled in a manner that prevents the carton from unintentionally unfolding. Typical trays are commonly of a unitary size and require items placed in the trays to be of a particular size as well, otherwise products can move within the tray.

The conventional methods and systems have generally been considered satisfactory for their intended purpose. However, there is still a need in the art for a blank and a tray providing improved carrying and securing abilities along with a simple folding process. There also remains a need in the art for such blanks and trays that are economically viable. The present disclosure may provide a solution for at least one of these remaining challenges, and provide a tray for accommodating one or more articles of various sizes, for example drinks, beverages, cans, cups, or the like, formed from a blank of paperboard or suitable foldable sheet material.

SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

A blank for forming a tray, the blank includes a first panel extending along a lateral axis configured to form an outer side of an erected tray, a second panel extending along the lateral axis coupled to the first panel by a fold line, the second panel being configured to form an inner side of the erected tray, wherein each of the first and second panels includes a base section, a first lateral section foldably coupled to the base section, a first end section foldably coupled to the first lateral section, a second lateral section foldably coupled to the base section, and a second end section foldably coupled to second lateral section.

Each of the first and second end sections can include a cutout therein configured to form a handle with the first end section and the second end section of the second panel in a face-contacting relationship. Each of the first and second lateral sections of the second panel can include a cutout therein configured to retain a portion of a respective article held in the erected tray or to provide access to an interior space of the erected tray. Each of the cutouts within the first and second lateral sections can include quadrilateral shape.

The base section of the second panel can include a plurality of base cutouts therein, each of the plurality of base cutouts configured to receive a portion of a respective article held in the erected tray, and plurality of base cutouts within the first panel each of the plurality of base cutouts configured to receive a portion of a respective article held in the erected tray. The base cutouts of the first panel can be of a different shape than the base cutouts of the second panel and be configured to retain differing portions of the respective article. A respective edge can be defined by each of the base cutouts of the second panel can be generally arcuate.

The first panel can include a plurality of segments, each of the plurality of segments foldably coupled to the base section and to one of the lateral sections, the plurality of segments being configured to form a plurality of article retainers when erected. Each of the segments can include at least one fold line bisecting each of the segments configured to form a kink in the article retainers. Adjacent segments can be separated laterally by at least a portion of the base section of the first panel. Adjacent segments can be separated transversely by at least a portion of the base section of the first panel. Each of the segments can include at least one side having a recess formed therein, the recess configured to receive a side wall of an article having a complementary shape to the recess. The second panel can include at least one cutout at least partially overlapping with at least one of the segments along a medial axis, the at least one cutout of the second panel configured to provide access to the segment from the outer side of at least a partially erected tray. Edges of a pair of segments can define a maximum width of the second panel and of the tray when measured across the lateral axis. Edges of the first panel can include at least one indentation configured to provide access to actuate the segments of the second panel when the blank is at least partially erected.

The first panel and the second panel can have different lengths measured along the lateral axis. The first panel and the second panel can have different widths measured orthogonally to the lateral axis. At least one of the first and second panels can include at least one adhesive strip configured to adhere the first panel to the second panel. The first panel and the second panel can be folded into face-contacting relationship across the first fold line to form a palletizable blank.

A tray includes a first outer side wall, a bottom outer wall hingedly attached to the first outer side wall, a second outer side wall hingedly attached to the bottom outer wall, a first inner side wall hingedly attached to the first outer side wall, a second inner side wall hingedly attached to the second outer side wall, wherein each wall comprises at least one opening formed therein, the opening configured to receive a portion of an article held in the tray. The tray can also include a bottom inner wall hingedly attached to each of the first inner side wall and the second inner side wall. The tray can also include a handle portion comprising a portion of the first outer wall and a portion of the second outer wall. Each of the inner side walls can include at least two article receptacles for receiving a bottom of an article. The article receptacles can be concave relative to an interior space of the tray. The article receptacles can include comprise an interior angle directed at an outer wall of the tray. Each of the inner side walls can include at least two windows formed therein configured to receive a portion of a top of an article. The tray can also include a gap between an inner side wall and a corresponding outer side wall, wherein the gap has a variable width.

A method of forming a tray is also disclosed. The method includes folding a first panel of a blank to lay on a second panel of a blank to form a folded blank, joining a first end of the folded blank to a second end of the folded blank to form a bottom wall, a first side wall, and a second side wall of the tray. The method can include pressing a portion of an inner wall of the folded blank into an interior space at least partially defined by the first side wall, the second side wall, and the bottom to form at least one container receptacle. The portion of the inner wall can be pressed through a cutout of an outer wall. The method can include inserting a container within a container receptacle prior to coupling the first end of the palletized blank and the second end of the palletized blank, wherein the container comprises a tapered portion.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION

Figure 1:
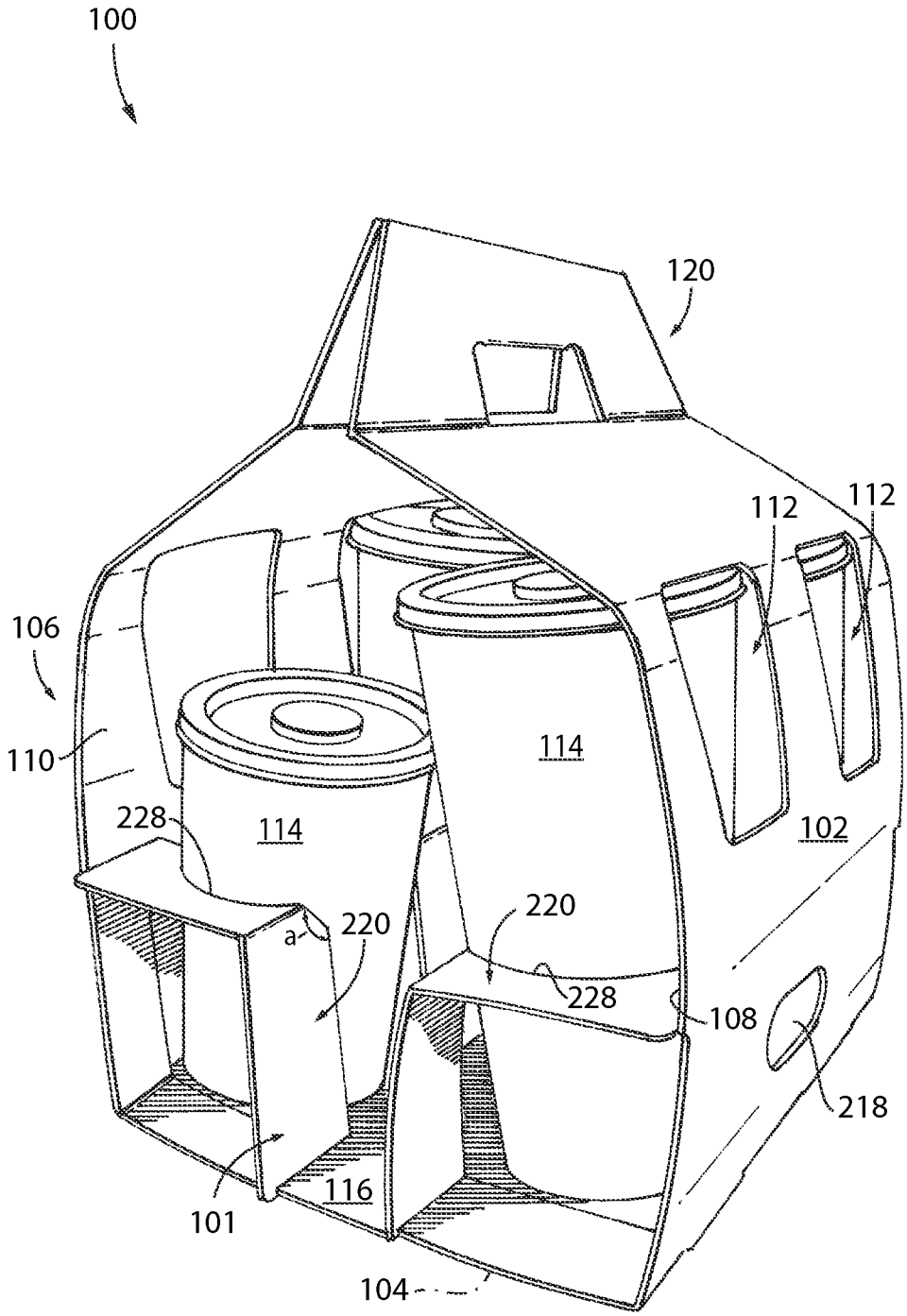
FIG. 1 is a perspective view of a tray of the present disclosure.

Reference will now be made to the drawings wherein like reference numerals identify similar structural features or aspects of the subject invention. For purposes of explanation and illustration, and not limitation, a partial view of an example of a tray in accordance with the invention is shown in FIG. 1 and is designated generally by reference character 100. Other examples of the tray in accordance with the invention, or aspects thereof, are provided in FIGS. 2-16, as will be described. The methods and systems of the invention can be used to provide a blank that can be easily folded into a tray that allows the transport and accommodation of articles, such as drink containers of various sizes, in a secure and covered arrangement.

FIG. 1 shows a perspective view of a tray 100. The tray may be formed from paperboard, cardboard, or other suitable materials. The tray shown in FIG. 1 includes a first outer side wall 102, a bottom outer wall 104 hingedly attached to the first outer side wall 102, a second outer side wall 106 hingedly attached to the bottom outer wall 104, a first inner side wall 108 hingedly attached to the first outer side wall 102, and a second inner side 110 wall hingedly attached to the second outer side wall 106. These walls form an outer and inner structure of the tray. The side walls 102, 106, 108, and 110 each include at least one opening or window 112 to receive a portion of an article 114 to be held in the tray 100. As an example, a top portion of a drink container is shown protruding through each of the windows 112. The tray shown in FIG. 1 includes four openings or windows 112 arranged in a 2×2 fashion for receiving between 1 and 4 articles. It is also considered that the tray can have other configurations such as but not limited to 3×2 and 4×2. The windows 112 receive an upper portion of each of the containers, respectively. The windows 112 are shaped similarly to a tapered trapezoid. This shape allows taller containers as well as shorter ones to partially protrude out of the windows 112 and be cradled by the edges of the windows 112.

FIG. 1 further shows a bottom inner wall 116 hingedly attached to the first inner side wall 108 and to the second inner side wall 110. The bottom inner wall 116 includes a portion coupled to the bottom outer wall 104 and a plurality of article receptacles 118 (shown in FIG. 6). The number and the arrangement of receptacles 118 (e.g., 2×2, 3×2, 4×2) match the number and arrangement of the windows 112. If the container 114 is too short to reach a bottom of the window 112, the container is still held in place by the receptacle 118. The receptacles 118 may be angled in a manner by which they create an angle (a) directed away from the interior space 101 of the tray 100 and towards an outer wall 102/106 of the tray 100. This angle (a) provides additional structure to the receptacles 118, improving the carrying weight capacity of the tray. The receptacles 118 include a generally arcuate hole for the containers 114 to be placed inside, but other shapes, including angles are also considered.

FIG. 1 further shows a handle portion 120 located at top of the tray 100 made from a portion of the first outer wall 102 and a portion of the second outer wall 106. The handle 120 is made by locking a portion of the first outer wall 102 to a portion of the second outer wall 106 via a foldable flap and cutout shown in FIG. 2. The handle 120 is configured to provide further stability to the tray 100 as well as a comfortable and secure way of carrying the tray 100.

Figure 2:
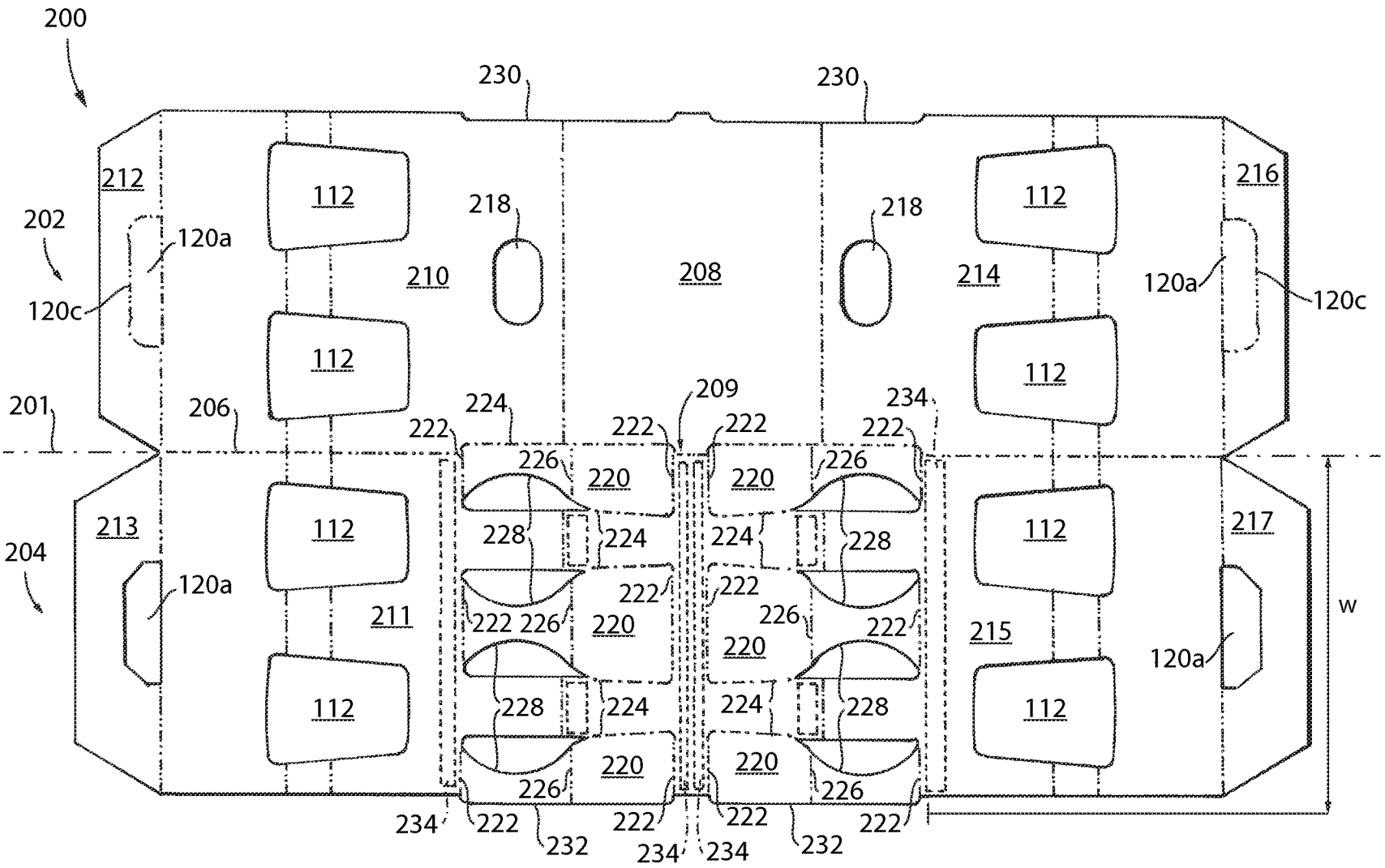
FIG. 2 is a plan view of a blank for forming the tray of FIG. 1, showing the fold lines, perforation lines, and glue lines.

FIG. 2 is a plan view of a blank 200 for forming the tray 100 of FIG. 1. The blank 200 includes a first panel 202 extending along a lateral axis 201, and when the blank is folded, the first panel 202 forms the outer side of the tray 100. A second panel 204 extends along the lateral axis 201 and is coupled to the first panel 202 by a fold line 206. The second panel forms an inner side of the tray 100 when erected.

Further shown in FIG. 2, each of the first and second panels 202/204 includes a base section 208/209, a first lateral section 210/211 foldably coupled to a respective base section 208/209, a first end section 212/213 coupled to a respective first lateral section 210/211, a second lateral section 214/215 foldably coupled to a respective base section 208/209, and a second end section 216/217 coupled to a respective second lateral section 214/215. Each of the end sections can be connected to their respective lateral sections by a fold line or by be an extension of each lateral section. Each of the first and second end sections 212/213/216/217 includes a cutout 120*a* which is used to form the handle 120 of FIG. 1 when the first end section 212/213 and the second end section 216/217 are joined in a face-contacting relationship. For example, the foldable cutout flap formed in end sections 212/216 may be folded over fold line 120*c* to extend through the opening formed by cutout 120*a* in end sections 213/217, as shown and described in more detail with reference to FIG. 8.

The second panel 204 includes a plurality of segments 220, which are coupled to the rest of the panel by a pair of fold lines 222, and a plurality of perforated lines 224. Adjacent pairs of segments 220 form the article receptacles 118 (FIG. 1) when the blank 200 is erected, breaking the perforated lines 224 and bending at the fold lines 222. Each of the segments 220 includes at least one fold line 226 bisecting each of the segments 220 which allows a kink to be formed when the article receptacles 118 are erected. Each of the segments 220 includes at least one side or edge having a recess 228. Adjacent recesses 228 form the edges of the receptacles 118 and are meant to receive, contour, and secure a side wall of the article or container 114. It is preferable to use a container or article with a complementary shape to the recess 228. The outer edges 232 of the two outer segments 220 define a maximum width (w) of the second panel 204 of the tray 100. The outer lateral side edges of the first panel 202 each include two indentations 230. The combination of the indentations 230 and the outer edges 232 of the segments 220 allow a user easy access to actuate the segments 220 when erecting the blank 200 since a portion of the segment hangs over the edge of the folded blank 200. Further shown in FIG. 2, access cutouts 218 are located on both the first lateral section 210 and the second lateral section 214 of the first panel 202. The access cutouts 218 allow access to an interior space 101 of the erected tray 100 in FIG. 1. This access allows a user to easily actuate the kinked receptacles in the middle of the tray 100 into place when erecting the tray.

Figure 3:
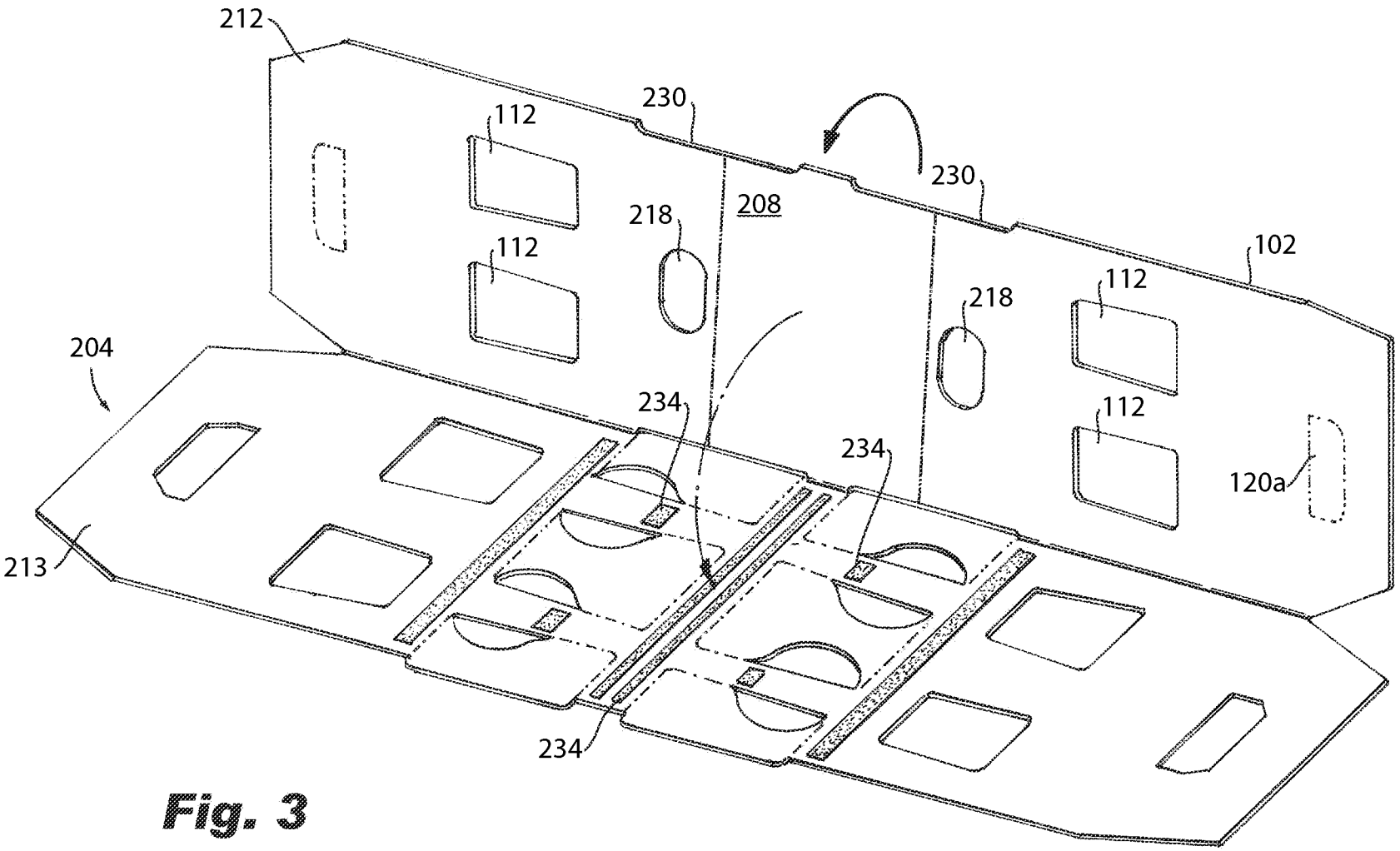
FIG. 3 is a perspective view of the blank of FIG. 2 showing a first folding step of the tray.
Figure 4:
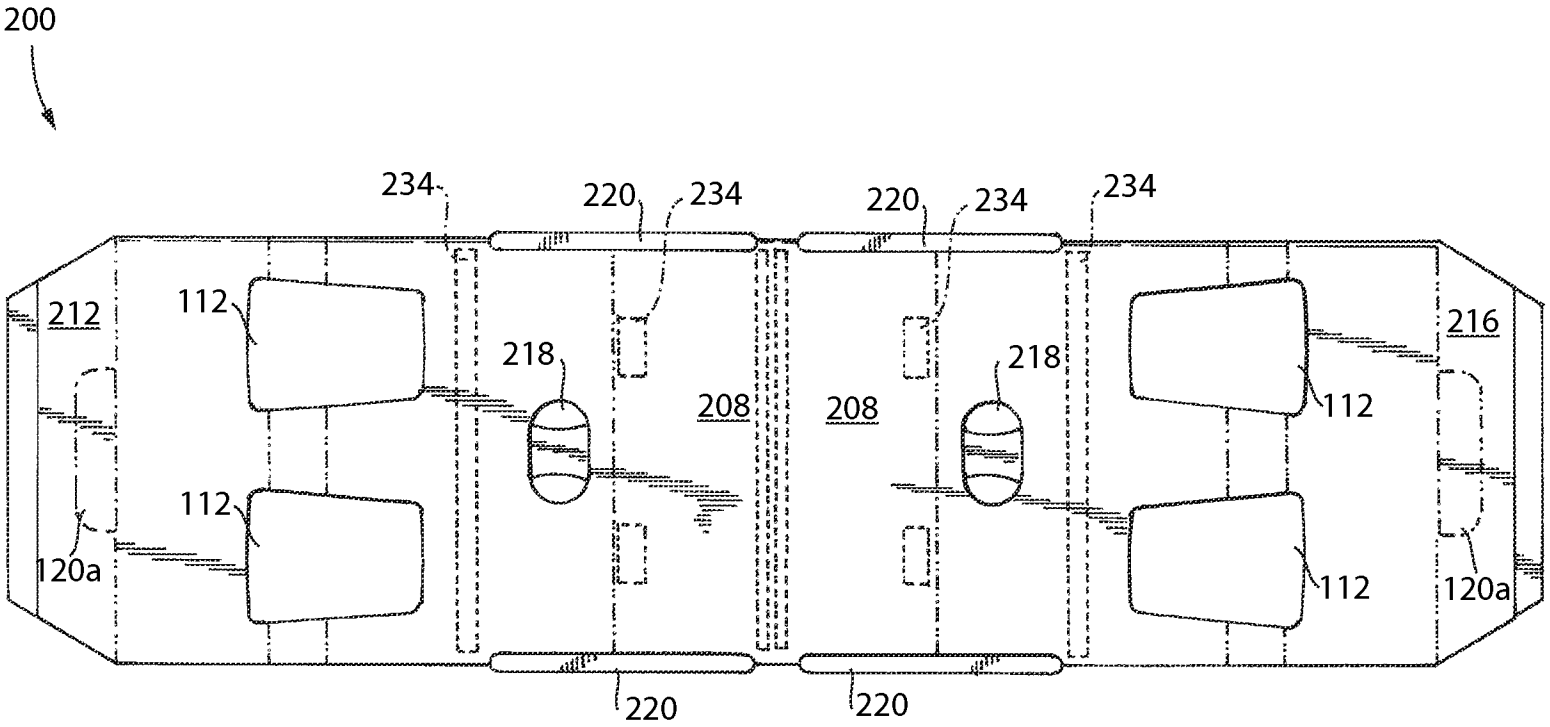
FIG. 4 is a top view of a blank for forming the tray of FIG. 1, showing a folded blank.
Figure 5:
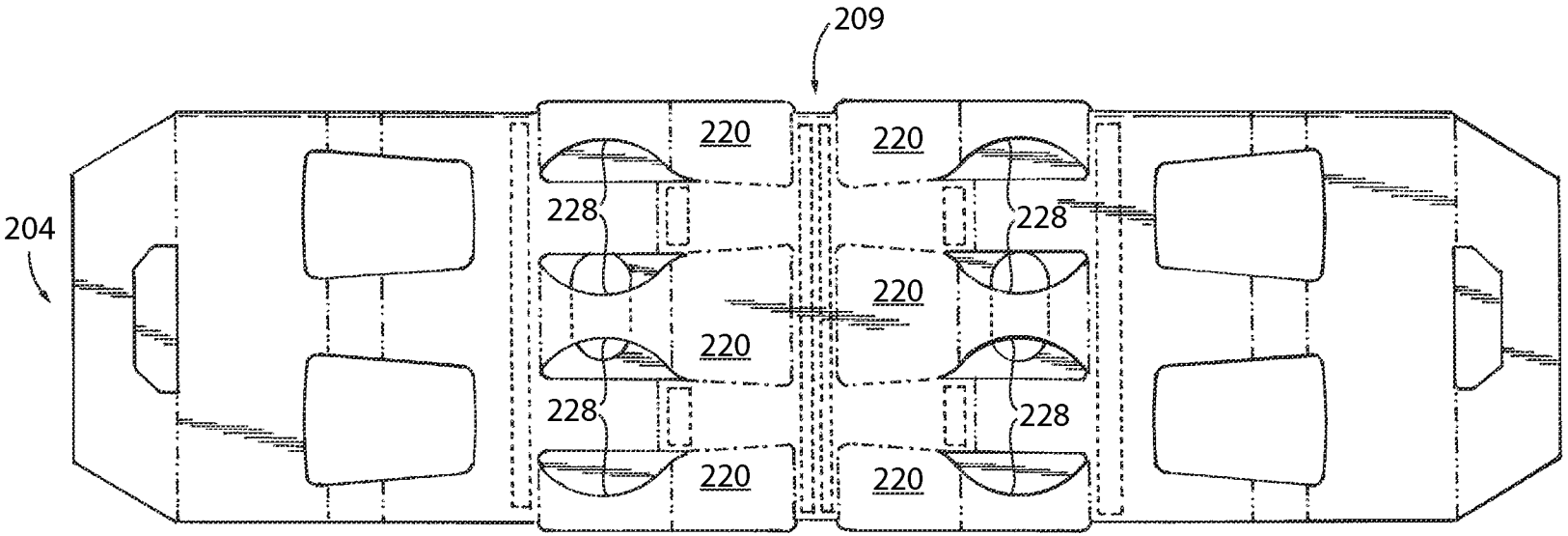
FIG. 5 is a bottom view of a blank for forming the tray of FIG. 1, showing a folded blank.
Figure 6:
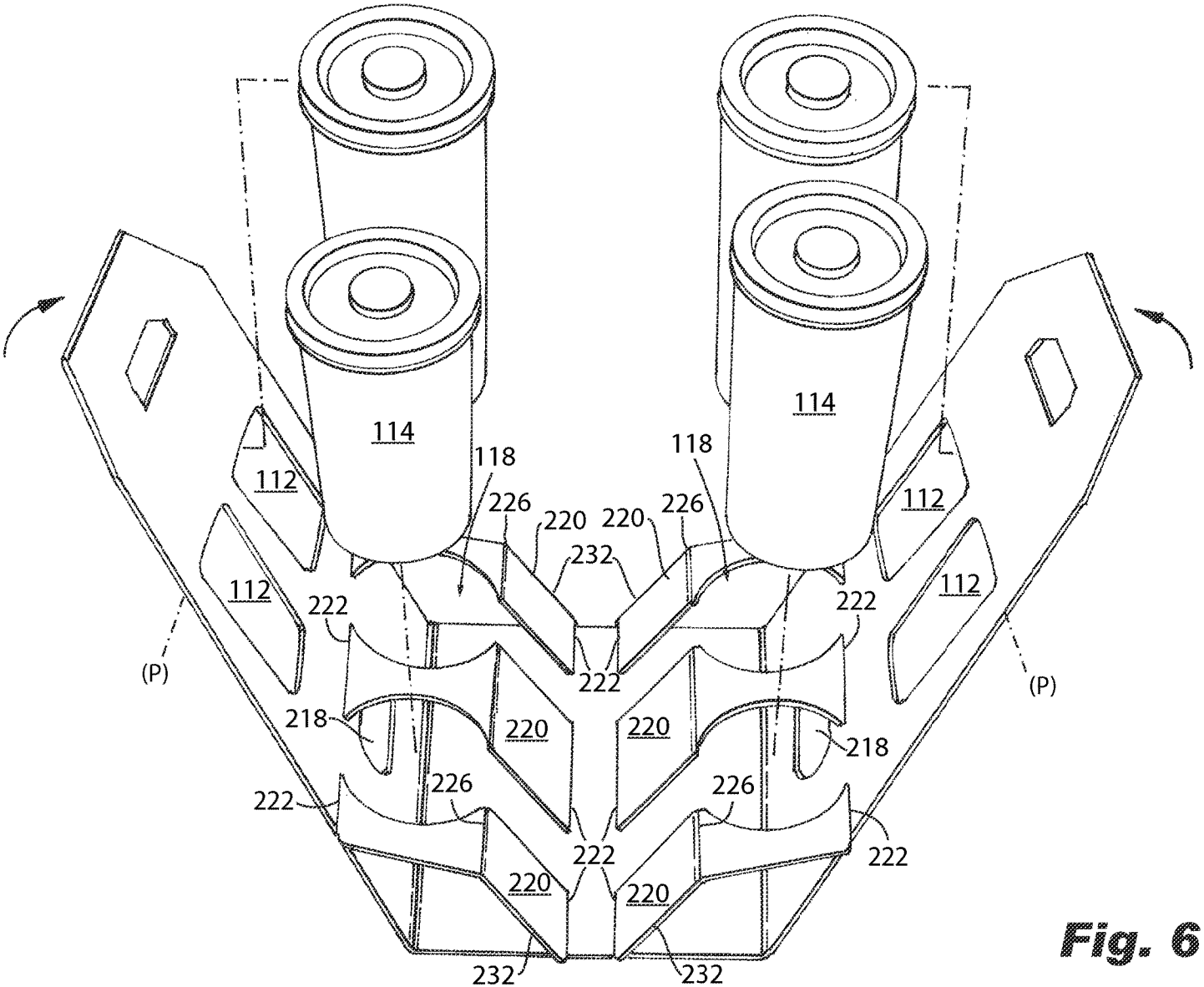
FIG. 6 is a perspective view of the blank of FIG. 2, showing a partially erected tray.

FIG. 3. shows a first folding step of the blank 200 into tray 100. The first panel 202 and the second panel 204 are folded to meet each other in a face-to face relationship over the fold line 206. The first panel 202 and the second panel 204 are then coupled by an adhesive to each other. The adhesive is shown as glue lines 234 on the second panel 204. FIG. 4 shows a resultant face-to-face relationship of the blank 200 showing the would-be outer side of the resultant tray 100. FIG. 5 shows a resultant face-to-face relationship of the blank showing the would-be inner side of the resultant tray 100. FIG. 6 shows a folding step of the blank 200, where the container receptacles 118 are partially formed by the segments 220 being folded as the first outer wall 102 and the second outer wall 106 are folded towards each other. FIG. 6 further shows the side walls being creased to form a bend or arcuate shape to the walls at a point (P) along the wall. The containers can be inserted once the receptacles 118 are at least partially formed and before the walls are fully erected and closed at the top of the tray or after the walls are fully erected.

Figure 7:
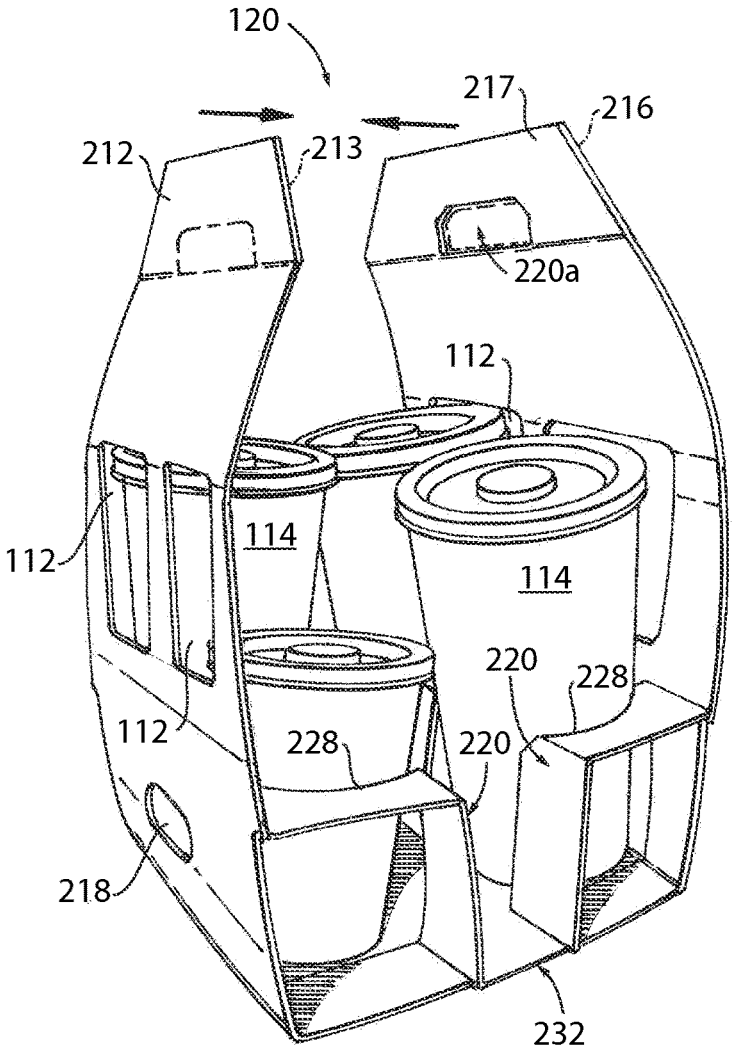
FIG. 7 is a perspective view of the blank of FIG. 2, showing a nearly erected tray.
Figure 8:
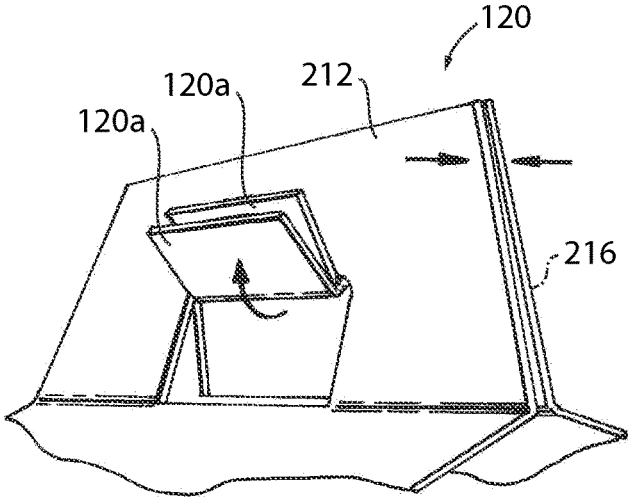
FIG. 8 is a perspective view of the blank of FIG. 2, showing a locking mechanism of the erected tray.

The containers can be various sizes and shapes, and can be placed in various configurations and arrangements. FIG. 7 shows the side walls 102, 106, 108, and 110 fully erected and the end portions being joined together to form the handle 120. FIG. 8 shows a locking method for forming the handle, where a portion 120*a* of one end is pressed through a cutout of the second end and folded to lock into place.

Figure 9:
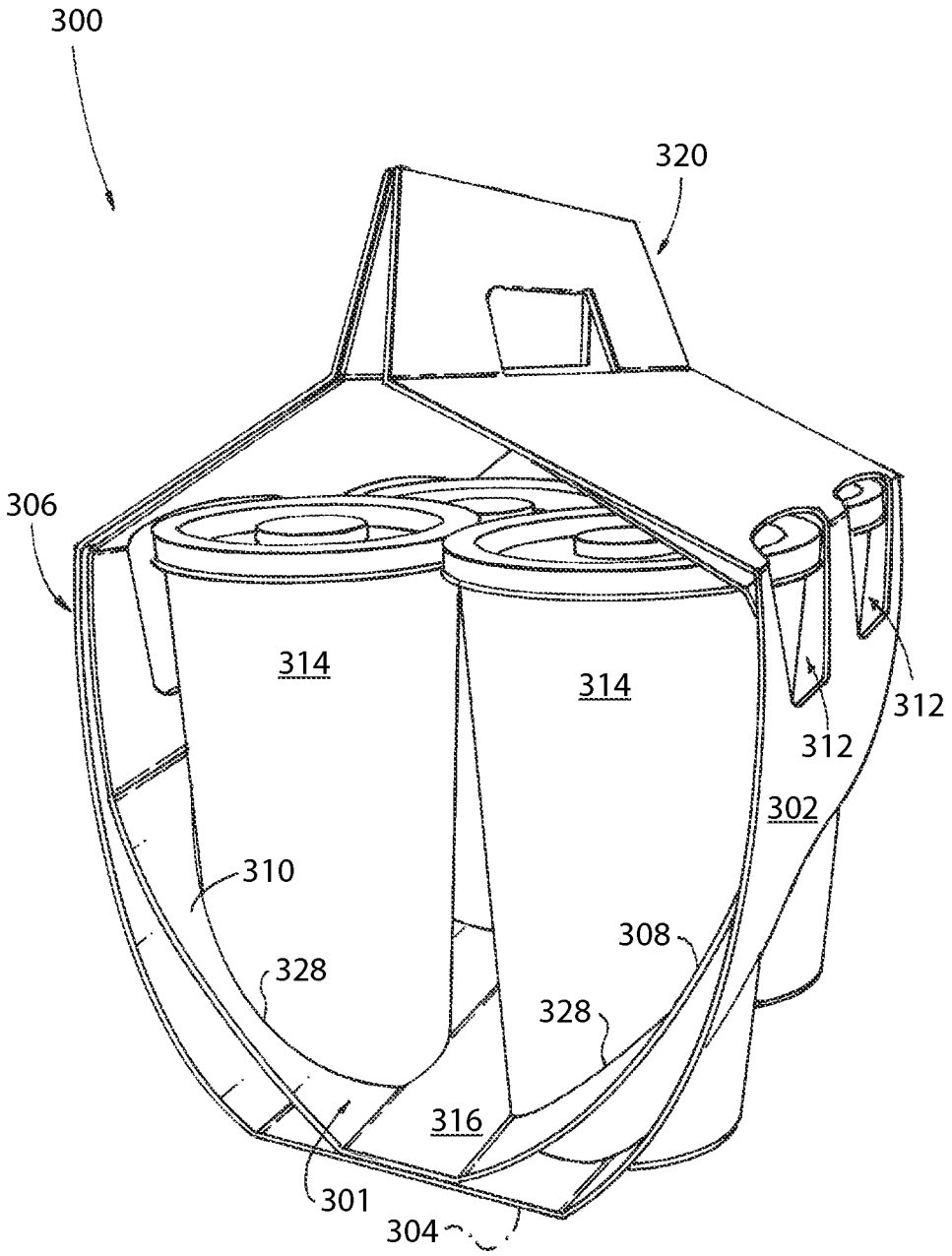
FIG. 9 is a perspective view of a tray of the present disclosure.

FIG. 9 shows a perspective view of a tray 300. Like tray 100, the tray 300 may be formed from paperboard, cardboard, or other suitable materials. The tray shown in FIG. 9 includes a first outer side wall 302, a bottom outer wall 304 hingedly attached to the first outer side wall 302, a second outer side wall 306 hingedly attached to the bottom outer wall 304, a first inner side wall 308 hingedly attached to the first outer side wall 302, and a second inner side 310 wall hingedly attached to the second outer side wall 306. These walls form an outer and inner structure of the tray. The side walls 302, 306, 308, and 310 each include at least one opening or window 312 to receive a portion of an article 314 to be held in the tray 300. As an example, a top portion of a drink container is shown protruding through each of the windows 312. The tray shown in FIG. 3 includes four openings or windows 312 arranged in a 2×2 fashion for receiving between 1 and 4 articles. It is also considered that the tray can have other configurations such as but not limited to 3×2 and 4×2. The windows 312 receive an upper portion of each of the containers, respectively. The windows 312 are shaped similarly to a tapered trapezoid. This shape allows taller containers as well as shorter ones to partially protrude out of the windows 312 and be cradled by the edges of the windows 312.

FIG. 9 further shows a bottom inner wall 316 hingedly attached to the first inner side wall 308 and to the second inner side wall 310. The bottom inner wall 316 includes a portion coupled to the bottom outer wall 304 and a plurality of container or article receptacles 328. The number and the arrangement of receptacles 318 (2×2, 3×2, 4×2) match the number and arrangement of the windows 312. If the container 314 is too short to reach a bottom of the window 312, the container is still held in place by the receptacle 318. The receptacles 318 are bowed in a manner by which they form a concave wall directed away from the interior space 301 of the tray 300 and towards an outer wall 302/306 of the tray 300. This arrangement does not require separate actuation to form the receptacles 318, as they are automatically formed by the folding of the side walls 302/306. The receptacles 318 include a generally arcuate hole for the containers 314 to be placed inside, but other shapes, including angles are also considered. FIG. 9 further shows a narrowing gap between an inner side wall 308/310 and a corresponding outer side wall 302/306, as the side walls extend upwardly.

FIG. 9 further shows a handle portion 320 located at top of the tray 300 made from a portion of the first outer wall 302 and a portion of the second outer wall 306. The handle 320 is made by locking a portion of the first outer wall 302 to a portion of the second outer wall 306. The handle 320 is configured to provide further stability to the tray 300 as well as a comfortable and secure way of carrying the tray 300.

Figure 10:
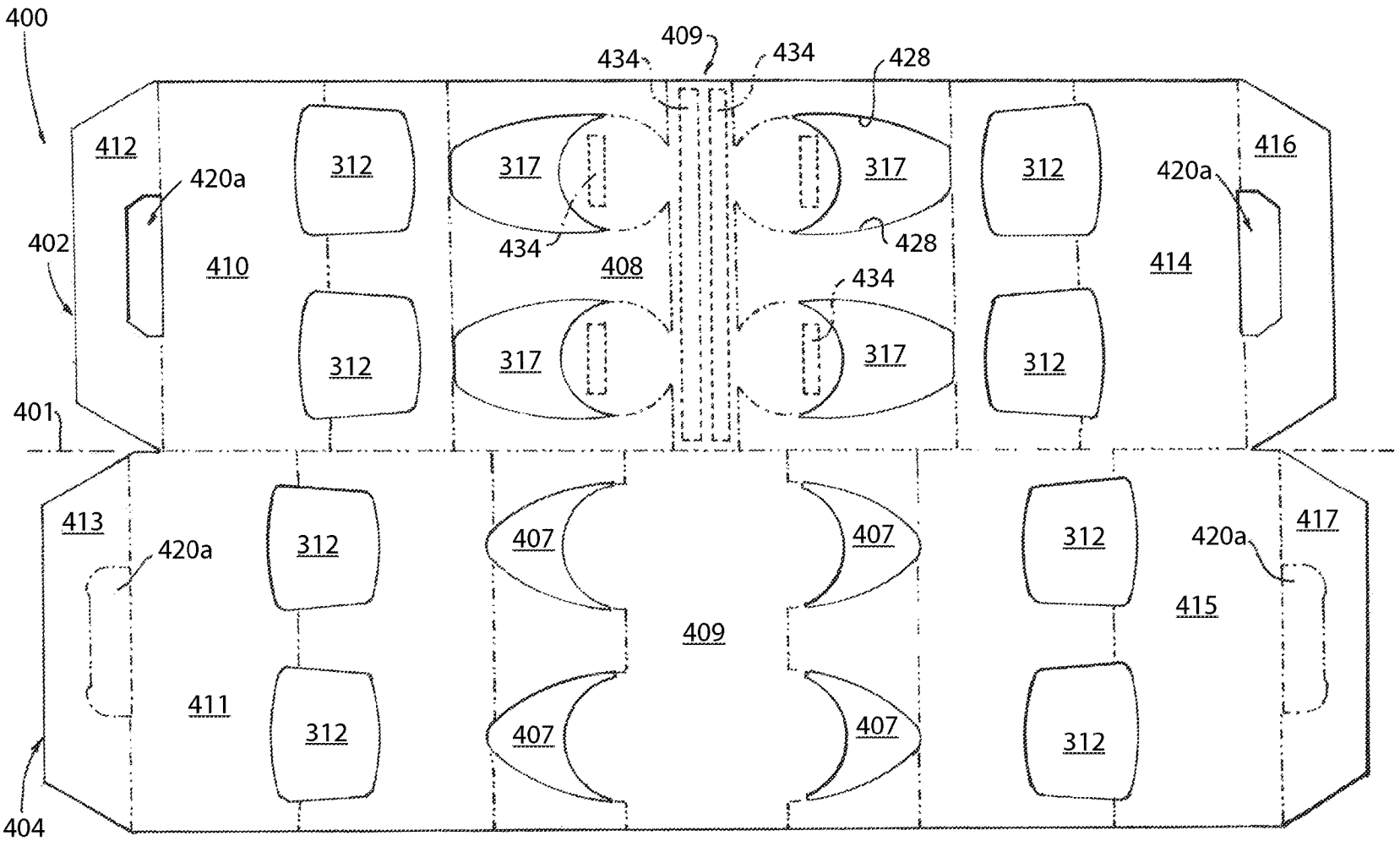
FIG. 10 is a plan view of a blank for forming the tray of FIG. 9, showing the fold lines, perforation lines, and glue lines.

FIG. 10 is a plan view of a blank 400 for forming the tray 300 of FIG. 1. The blank 400 includes a first panel 402 extending along a lateral axis 401, and when the blank is folded, the first panel 402 forms the outer side of the tray 300. A second panel 404 extends along the lateral axis 401 and is coupled to the first panel 402 by a fold line 406. The second panel forms an inner side of the tray 300 when erected.

Further shown in FIG. 10, each of the first and second panels 402/404 includes a base section 408/409, a first lateral section 410/411 foldably coupled to a respective base section 408/409, a first end section 412/413 foldably coupled to a respective first lateral section 410/411, a second lateral section 414/415 foldably coupled to a respective base section 408/409, and a second end section 416/417 foldably coupled to a respective second lateral section 414/415. Each of the first and second end sections 412/413/416/417 includes a cutout 420*a* which is used to form the handle 320 of FIG. 9 when the first end section 412/413 and the second end section 416/417 are joined in a face-contacting relationship.

Further shown in FIG. 10, the first panel 402 and the second panel 404 have different lengths measured along the lateral axis and the first panel 402 and the second panel 404 have different widths measured orthogonally to the lateral axis. The difference in lengths allows the windows 312 to line-up with each other across the different walls when the tray 300 is erected, and allows the lengths of the folded outer and inner walls to be substantially equal when the tray 300 is erected.

Figure 11:
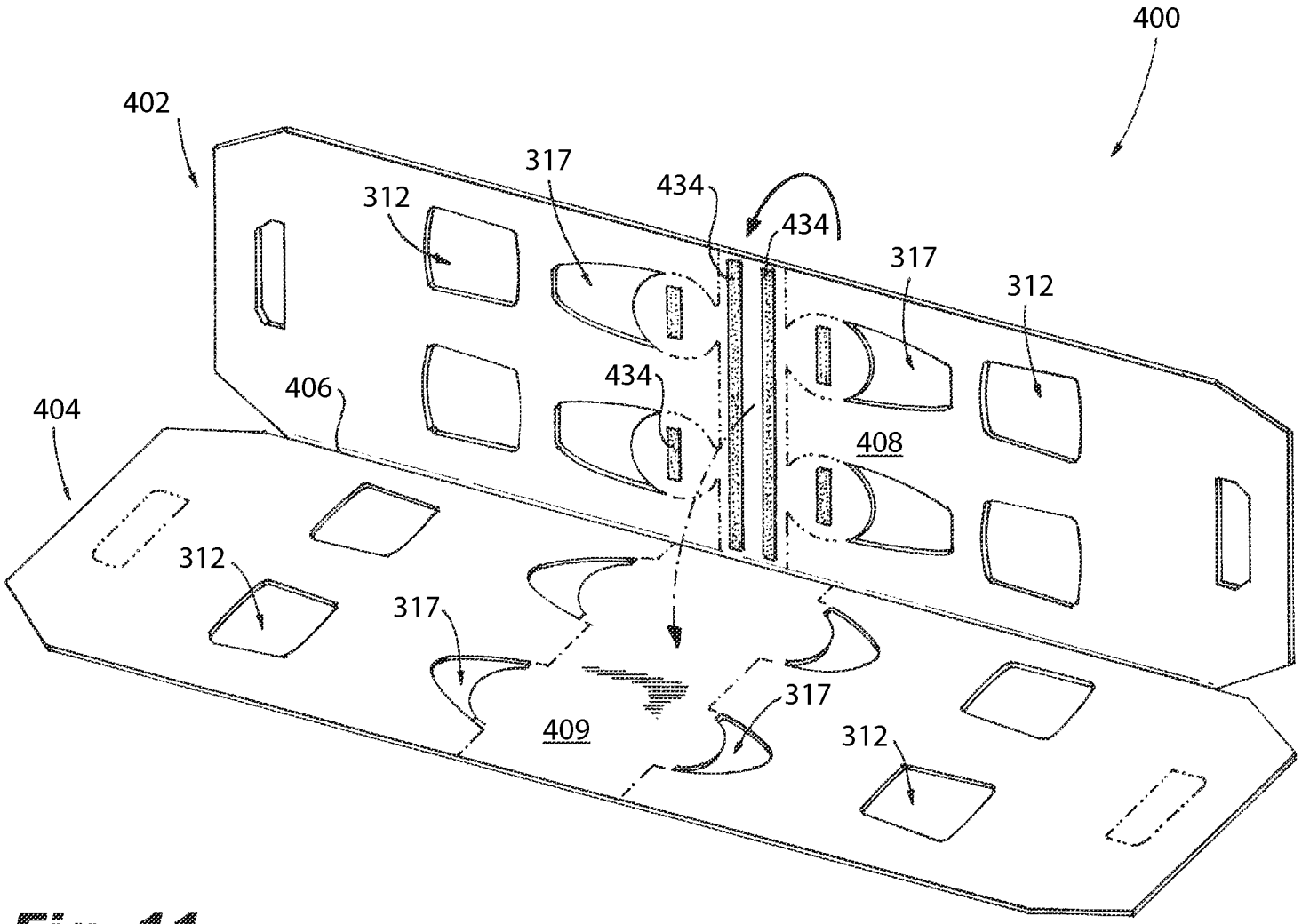
FIG. 11 is a perspective view of the blank of FIG. 10 showing a first folding step of the tray.
Figure 12:
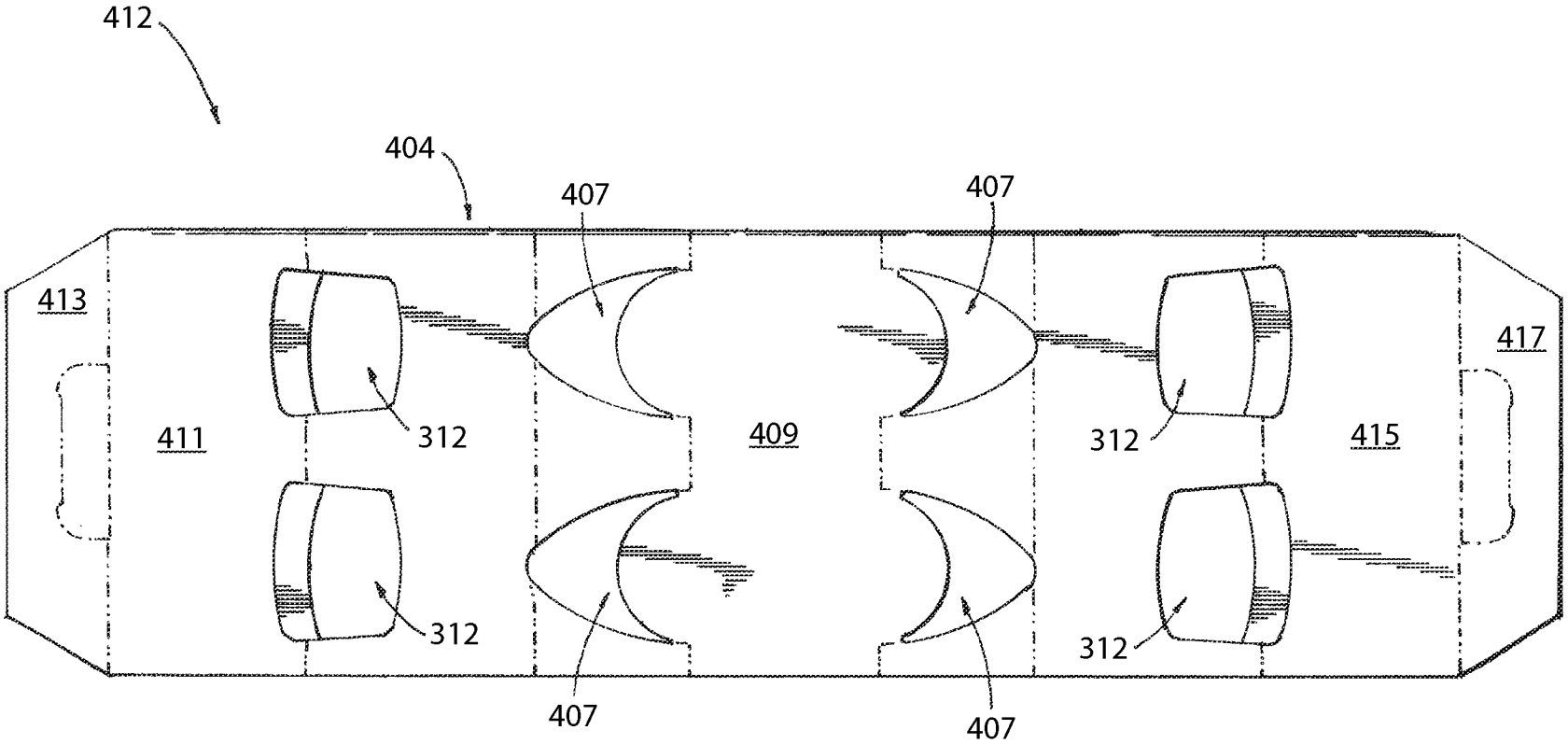
FIG. 12 is an inner side view of a blank for forming the tray of FIG. 9, showing a folded blank.
Figure 13:
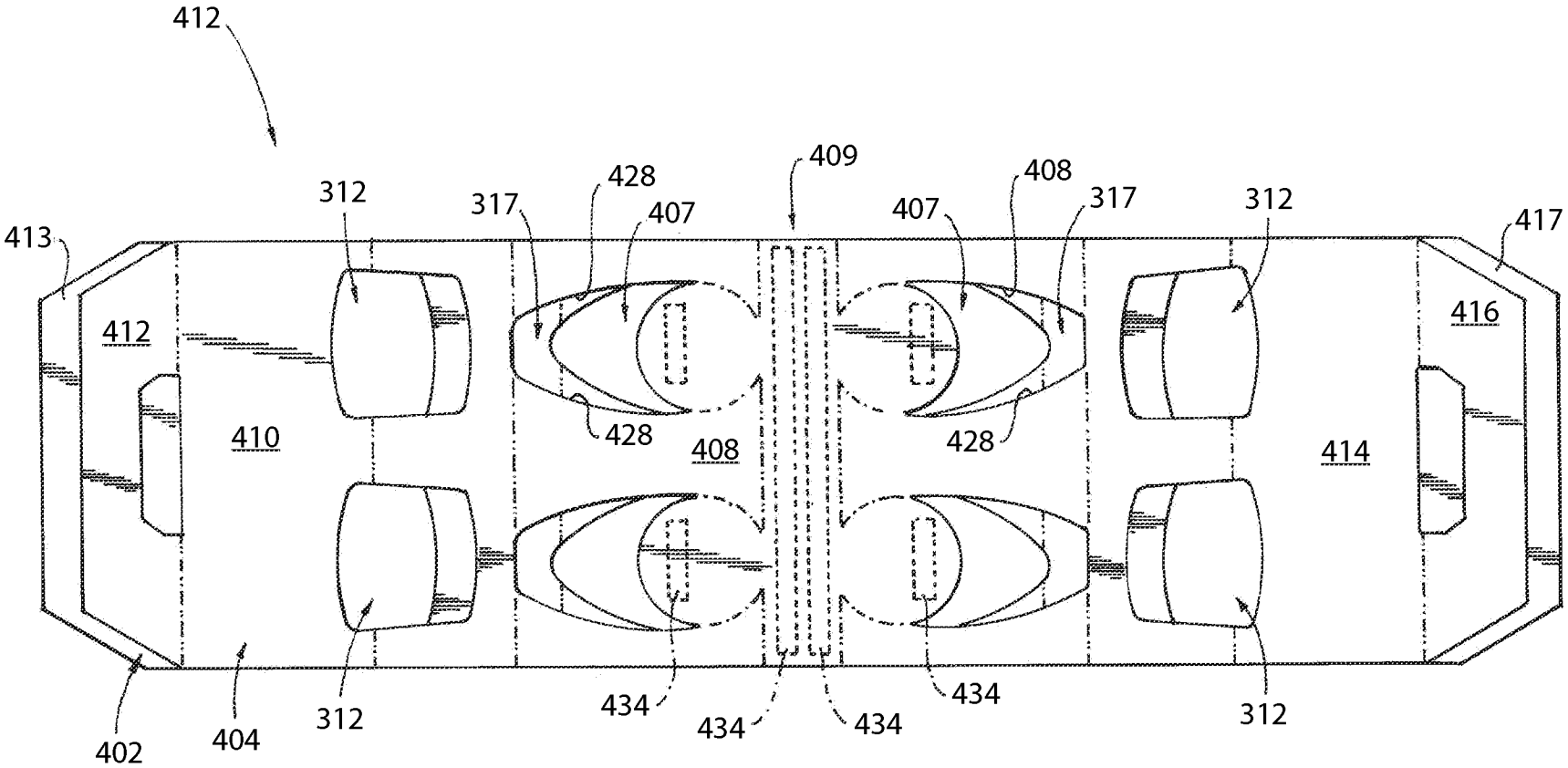
FIG. 13 is an outer side view of a blank for forming the tray of FIG. 9, showing a folded blank.
Figure 14:
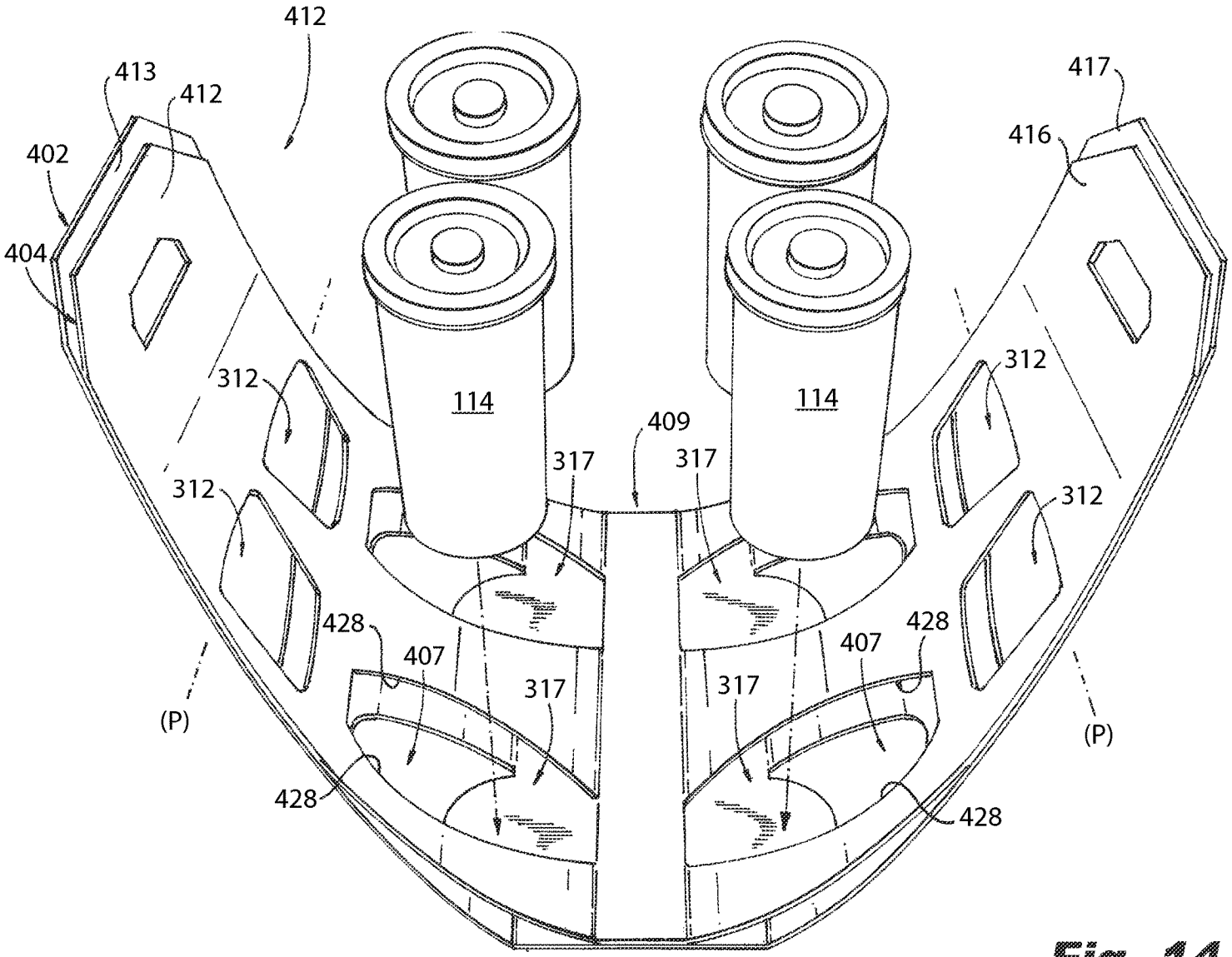
FIG. 14 is a perspective view of the blank of FIG. 12, showing a partially erected tray.

FIG. 11. shows a first folding step of the blank 400 into tray 300. The first panel 402 and the second panel 404 are folded to meet each other in a face-to face relationship over the fold line 406. The first panel 402 and the second panel 404 are then coupled by an adhesive to each other. The adhesive is shown as glue lines 434 on the first panel 402. FIG. 12 shows a resultant face-to-face relationship of the blank 400 showing the would-be outer side of the resultant tray 300. FIG. 13 shows a resultant face-to-face relationship of the blank showing the would-be inner side of the resultant tray 300. FIG. 14 shows a folding step of the blank 400, where the container receptacles 428 are partially formed as the first outer wall 304 and the second outer wall 306 are folded towards each other. FIG. 14 further shows the side walls being creased to form a bend or arcuate shape to the walls at a point (P) along the side walls. The containers can be inserted once the receptacles 318 are at least partially formed and before the walls are fully erected and closed at the top of the tray or after the walls are fully erected.

Figure 15:
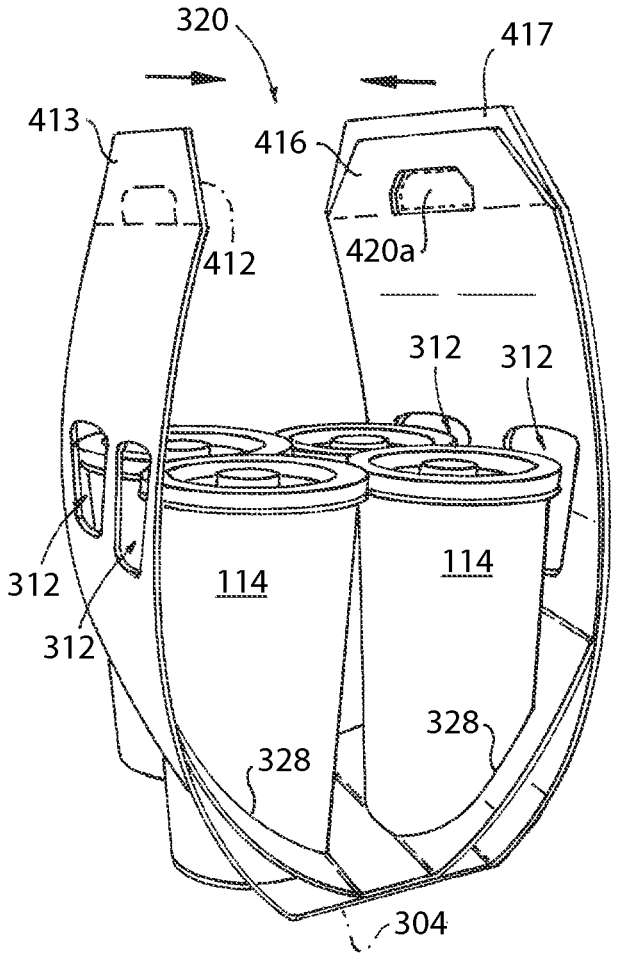
FIG. 15 is a perspective view of the blank of FIG. 12, showing a nearly erected tray.
Figure 16:
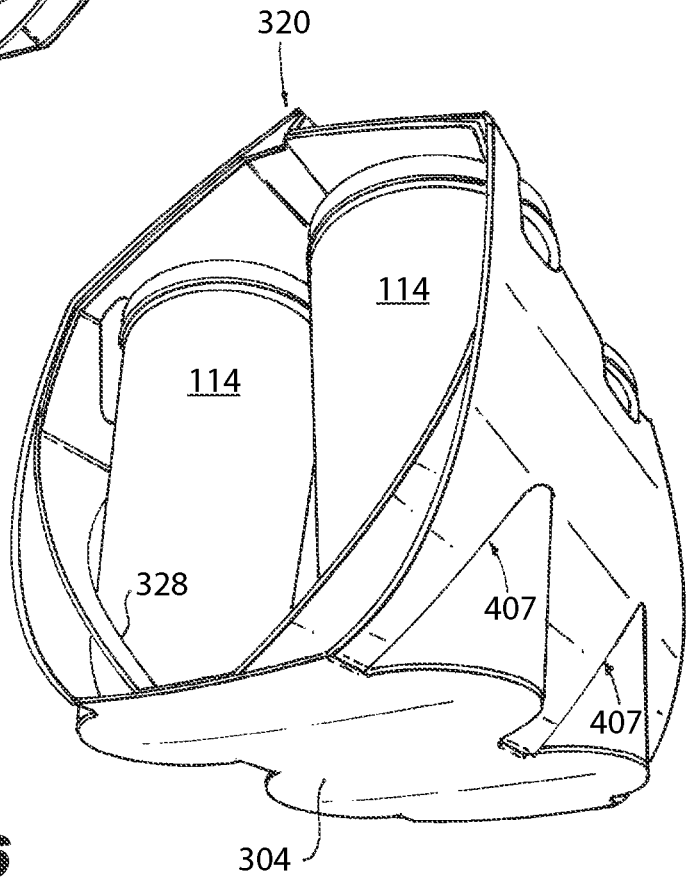
FIG. 16 is a bottom view of the tray of FIG. 9, showing an arrangement of the containers.

The containers can be various sizes and shapes, and can be placed in various configurations and arrangements. FIG. 15 shows the side walls 302, 306, 308, and 310 fully erected and the end portions being joined together to form the handle 320. FIG. 16 shows an underside view of the tray 300. The tray 300 allows a portion of the bottoms of the containers to protrude through the outer side walls 302/306 due to cutouts 407 located in the base section 409 of the second panel 404.

The methods and systems of the present disclosure, as described above and shown in the drawings, provide for a tray and blank for forming the tray with superior properties including increased strength, ease of assembly and adaptability to different sized articles held therein. While the apparatus and methods of the subject disclosure have been shown and described with reference to certain examples, those skilled in the art will readily appreciate that changes and/or modifications may be made thereto without departing from the spirit and score of the subject disclosure.

What is claimed is:

1. A blank for forming a tray that, upon being formed as an erected tray, is configured to hold a plurality of articles within its formed side walls, the blank comprising:

an outer panel extending along a lateral axis configured to form an outer side of an the erected tray;

an inner panel extending along the lateral axis coupled to the outer panel by a fold line, the inner panel being configured to form an inner side of the erected tray;

wherein each of the outer and inner panels comprises:

a base section;

a first lateral section foldably coupled to the base section;

a first end section coupled to the first lateral section;

a second lateral section foldably coupled to the base section; and a second end section coupled to the second lateral section, wherein each of the first and second lateral sections of the outer panel are configured to form the outer side of the side walls of the erected tray, respectively, and each of the first and second lateral sections of the inner panel are configured to form the inner side of the side walls of the erected tray, respectively, wherein each of the first and second lateral sections of the outer panel comprise a first integer number of openings and each of the first and second lateral sections of the inner panel comprise a second integer number of openings, the first integer number of openings in each of the first and second lateral sections of the outer panel being equal to the second integer number of openings of each of the first and second lateral sections of the inner panel, wherein the openings of each of the first and second lateral sections of the outer panel and the openings of each of the first and second lateral sections of the inner panel are arranged to form windows in the side walls that provide access to an upper portion of respective articles held in the erected tray.

2. The blank of claim 1, wherein at least one of the first or second end sections comprises a cutout formed therein configured to form a handle with the first end section and the second end section of the inner panel in an at least partial face-contacting relationship.

3. The blank of claim 1, wherein a sum of the first integer number of openings and the second integer number of openings is equivalent to a maximum number of articles that the tray is formed to hold.

4. The blank of claim 3, wherein each of the openings within the first and second lateral sections comprises a quadrilateral shape configured to retain a portion of a respective article to be held in the erected tray.

5. The blank of claim 1, wherein the base section of the inner panel comprises a plurality of base cutouts formed therein, each of the plurality of base cutouts configured to receive a portion of a respective article to be held in the erected tray.

6. The blank of claim 5, further comprising a plurality of base cutouts formed in the base section of the outer panel, wherein each of the plurality of base cutouts of the outer panel are configured to receive a portion of a respective article to be held in the erected tray.

7. The blank of claim 6, wherein the base cutouts of the outer panel are of a different shape than the base cutouts of the inner panel and are configured to retain differing portions of the respective article.

8. The blank of claim 1, wherein the outer panel and the inner panel have at least one of: (i) different lengths measured along the lateral axis, and (ii) different widths measured orthogonally to the lateral axis.

9. The blank of claim 1, wherein at least one of the outer and inner panels comprises at least one adhesive strip configured to adhere the outer panel to the inner panel.

10. The blank of claim 1, wherein the outer panel and the inner panel are folded into face-contacting relationship across the first fold line to form a palletizable blank.

11. A blank for forming a tray, the blank comprising:

a first panel extending along a lateral axis configured to form an outer side of an erected tray;

a second panel extending along the lateral axis coupled to the first panel by a fold line, the second panel being configured to form an inner side of the erected tray;

wherein each of the first and second panels comprises:

a base section;

a first lateral section foldably coupled to the base section;

a first end section coupled to the first lateral section;

a second lateral section foldably coupled to the base section; and a second end section coupled to the second lateral section, wherein the second panel comprises a plurality of segments, each of the plurality of segments foldably coupled to the base section and to one of the lateral sections, the plurality of segments being configured to form a plurality of article retainers when erected.

12. The blank of claim 11, wherein each of the segments comprises at least one fold line bisecting each of the segments configured to form a kink in the article retainers.

13. The blank of claim 11, wherein adjacent segments are separated laterally or transversely or both laterally and transversely by at least a portion of the base section of the first panel.

14. The blank of claim 11, wherein each of the segments comprises at least one side having a recess formed therein, the recess configured to receive a side wall of an article having a complementary shape to the recess.

15. The blank of claim 11, wherein the first panel comprises at least one cutout at least partially overlapping with at least one of the segments along a medial axis, the at least one cutout of the first panel configured to provide access to the segment from the outer side of at least a partially erected tray.

16. A tray comprising:

a first outer side wall;

a bottom outer wall hingedly attached to the first outer side wall;

a second outer side wall hingedly attached to the bottom outer wall;

a first inner side wall hingedly attached to the first outer side wall;

a second inner side wall hingedly attached to the second outer side wall; and a bottom inner wall hingedly attached to each of the first inner side wall and the second inner side wall, wherein each of the first outer side wall, the second outer side wall, the first inner side wall, and the second inner side wall comprises at least one opening formed therein, each opening configured to receive a portion of an article to be held in the tray, and wherein the bottom inner wall comprises at least two article receptacles formed at least partially therein, each of the at least two article receptables configured to receive a bottom portion of a respective article to be held in the tray.

17. The tray of claim 16, further comprising a handle portion comprising a portion of the first outer wall and a portion of the second outer wall.

18. The tray of claim 16, wherein the bottom outer wall comprises a plurality of base cutouts formed therein, wherein each of the plurality of base cutouts is configured to receive a lower portion of a respective article to be held in the tray.

19. The tray of claim 16, wherein each of the inner side walls comprises at least one window formed therein configured to receive a portion of a top of an article.

20. The tray of claim 16, wherein a sum of the at least one opening formed in the first outer side wall and the at least one opening formed in the second outer side wall is equal to a maximum number of articles that can be held in the tray, which is also equal to a sum of the at least one opening formed in the first inner side wall and the at least one opening formed in the second inner side wall.

* * * * *